US009545789B2

(12) United States Patent
Yamada

(10) Patent No.: US 9,545,789 B2
(45) Date of Patent: Jan. 17, 2017

(54) LIQUID EJECTING APPARATUS, HEAD UNIT, INTEGRATED CIRCUIT DEVICE FOR DRIVING CAPACITIVE LOAD, AND CAPACITIVE LOAD DRIVING CIRCUIT

(71) Applicant: Seiko Epson Corporation, Tokyo (JP)

(72) Inventor: Tomokazu Yamada, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/829,907

(22) Filed: Aug. 19, 2015

(65) Prior Publication Data

US 2016/0144616 A1 May 26, 2016

(30) Foreign Application Priority Data

Nov. 25, 2014 (JP) ..... 2014-237406

(51) Int. Cl.
*B41J 2/045* (2006.01)

(52) U.S. Cl.
CPC ..... *B41J 2/04541* (2013.01); *B41J 2/04501* (2013.01); *B41J 2/04548* (2013.01); *B41J 2/04581* (2013.01); *B41J 2/04588* (2013.01); *B41J 2/04593* (2013.01)

(58) Field of Classification Search
CPC ... B41J 2/04501; B41J 2/04548; B41J 2/0455; B41J 2/04581
See application file for complete search history.

(56) References Cited

U.S. PATENT DOCUMENTS

2002/0145637 A1* 10/2002 Umeda ..... B41J 2/04581 347/9
2008/0198191 A1* 8/2008 Oshima ..... B41J 29/38 347/10

FOREIGN PATENT DOCUMENTS

JP 2010-114711 A 5/2010

* cited by examiner

*Primary Examiner* — Kristal Feggins
*Assistant Examiner* — Kendrick Liu
(74) *Attorney, Agent, or Firm* — Harness, Dickey & Pierce, P.L.C.

(57) ABSTRACT

A liquid ejecting apparatus according to the invention includes: a modulation unit that generates a modulated signal which is obtained by pulse-modulating an original signal; a gate driver that generates an amplification control signal, based on the modulated signal; a transistor that generates an amplified and modulated signal which is obtained by amplifying the modulated signal, based on the amplification control signal; a low pass filter that generates a drive signal by demodulating the amplified and modulated signal; a piezoelectric element that is displaced by the drive signal which is applied; a first power supply unit that applies a signal to a terminal of the piezoelectric element, other than a terminal to which the drive signal is applied; a cavity; and a nozzle, wherein the gate driver and the first power supply unit are connected to a common ground terminal.

7 Claims, 10 Drawing Sheets

<DECODING CONTENT OF DECODER>

| PRINTING DATA Data | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB

LIQUID EJECTING APPARATUS, HEAD UNIT, INTEGRATED CIRCUIT DEVICE FOR DRIVING CAPACITIVE LOAD, AND CAPACITIVE LOAD DRIVING CIRCUIT

The entire disclosure of Japanese Patent Application No. 2014-237406, filed Nov. 25, 2014 is expressly incorporated by reference herein.

BACKGROUND

1. Technical Field

The present invention relates to a liquid ejecting apparatus, a head unit, an integrated circuit device for driving a capacitive load, and a capacitive load driving circuit.

2. Related Art

It is known that a liquid ejecting apparatus such as an ink jet printer which prints an image or a document by ejecting ink uses piezoelectric elements (for example, piezo elements). The piezoelectric elements are provided in correspondence with each of a plurality of nozzles of a head unit, each of the piezoelectric elements is driven in accordance with a drive signal, and thereby a predetermined amount of ink (liquid) is ejected from the nozzles at a predetermined timing, and thus dots are formed. The piezoelectric element is a capacitive load such as a capacitor from the viewpoint of electricity, and thus it is necessary to supply a sufficient current, in order to operate the piezoelectric elements of the respective nozzles.

For this reason, the liquid ejecting apparatus described above has a configuration in which a drive signal amplified by an amplification circuit is supplied to a head unit (ink jet driver) and thereby the piezoelectric element is driven. The amplification circuit uses a method for amplifying a current of an original signal before amplification in a class AB mode or the like, but energy efficiency is poor. Thus, in recent years, a class D amplifier has been proposed (refer to JP-A-2010-114711).

In order to obtain (output waveform becomes highly accurate) high ejection accuracy, a class D amplifier for an ink jet head requires an oscillation frequency (1 MHz to 8 MHz) higher than that of a class D amplifier for audio, by 20 times or more. However, because of the high oscillation frequency, the amplifier has features that are susceptible to various noises. For this reason, the present inventors have found that, in the class D amplifier for an ink jet, component layout in the inside of an IC in which significance to be considered for audio is small is important for reducing noise.

SUMMARY

An advantage of some aspects of the invention is to provide a liquid ejecting apparatus, a head unit, an integrated circuit device for driving a capacitive load, and a capacitive load driving circuit which can increase ejection accuracy of liquid.

The invention can be realized by the following aspects or application examples.

APPLICATION EXAMPLE 1

According to this application example, there is provided a liquid ejecting apparatus including: a modulation unit that generates a modulated signal which is obtained by pulse-modulating an original signal; a gate driver that generates an amplification control signal, based on the modulated signal; a transistor that generates an amplified and modulated signal which is obtained by amplifying the modulated signal, based on the amplification control signal; a low pass filter that generates a drive signal by demodulating the amplified and modulated signal; a piezoelectric element that is displaced by the drive signal which is applied; a first power supply unit that applies a signal to a terminal of the piezoelectric element, other than a terminal to which the drive signal is applied;

a cavity which is filled with liquid therein, and whose internal volume is changed by displacement of the piezoelectric element; and a nozzle that communicates with the cavity, and ejects the liquid in the cavity as droplets in accordance with change of the internal volume of the cavity, in which the gate driver and the first power supply unit are connected to a common ground terminal.

According to the application example, since the gate driver and the first power supply unit are connected to the common ground terminal, in a case in which noise is superimposed on a ground potential, the noise that is superimposed on a signal which is applied to both terminals of the piezoelectric element is cancelled each other out. Therefore, a voltage that is applied to the piezoelectric element can be accurately controlled, and thus, it is possible to realize a liquid ejecting apparatus that can increase ejection accuracy of liquid.

APPLICATION EXAMPLE 2

In the liquid ejecting apparatus, the gate driver may include a first gate driver and a second gate driver that operates at a potential side lower than that of the first gate driver, and the second gate driver and the first power supply unit may be connected to the common ground terminal.

According to the application example, since the second gate driver and the first power supply unit are connected to the common ground terminal, in a case in which noise is superimposed on a ground potential, the noise that is superimposed on a signal which is applied to both terminals of the piezoelectric element is cancelled each other out. Therefore, a voltage that is applied to the piezoelectric element can be accurately controlled, and thus, it is possible to realize a liquid ejecting apparatus that can increase ejection accuracy of liquid.

APPLICATION EXAMPLE 3

In the liquid ejecting apparatus, the apparatus may further include a voltage boosting circuit that supplies a power supply voltage to the gate driver, and the gate driver and the first power supply unit and the voltage boosting circuit may be connected to the common ground terminal.

According to the application example, noise of a ground potential caused by the voltage boosting circuit can be made to be the same phase by the first power supply unit and the voltage boosting circuit. The noise that is superimposed on a signal which is applied to both terminals of the piezoelectric element is cancelled each other out. Therefore, a voltage that is applied to the piezoelectric element can be accurately controlled, and thus, it is possible to realize a liquid ejecting apparatus that can increase ejection accuracy of liquid.

APPLICATION EXAMPLE 4

In the liquid ejecting apparatus, the first power supply unit and the voltage boosting circuit may be adjacently positioned.

According to the application example, the first power supply unit with a stable potential, and the voltage boosting circuit that is a source of noise are adjacently positioned, and thus it is possible to prevent the noise from transferring to other circuit blocks. Thus, a voltage that is applied to the piezoelectric element can be accurately controlled, and thus, it is possible to realize the liquid ejecting apparatus which can increase ejection accuracy of liquid.

APPLICATION EXAMPLE 5

In the liquid ejecting apparatus, the voltage boosting circuit may be a charge pump circuit.

According to the application example, the occurrence of noise can be suppressed, compared to a case in which a switching regulator circuit is used as the voltage boosting circuit. Therefore, the voltage that is applied to the piezoelectric element can be accurately controlled, and thus it is possible to realize the liquid ejecting apparatus which can increase ejection accuracy of liquid.

APPLICATION EXAMPLE 6

In the liquid ejecting apparatus, an oscillation frequency of the modulated signal may be equal to or higher than 1 MHz and may be equal to or lower than 8 MHz.

In the liquid ejecting apparatus described above, the amplified and modulated signal is smoothed and thereby the drive signal is generated, the drive signal is applied and thereby the piezoelectric element is displaced, and thus the liquid is ejected from the nozzle. Here, if a frequency spectrum of the waveform of the drive signal for ejecting, for example, a small dot using the liquid ejecting apparatus is analyzed, it is found that frequency components equal to or higher than 50 kHz are contained. In order to generate a drive signal that contains the frequency components equal to or higher than 50 kHz, it is necessary to set the frequency (frequency of self-excited oscillation) of the modulated signal to a frequency equal to or higher than 1 MHz.

If the frequency is lower than 1 MHz, an edge of the waveform of the drive signal to be reproduced becomes dull thereby becoming round. In other words, an angle is rounded, and thereby the waveforms become dull. If the waveform of the drive signal becomes dull, the displacement of the piezoelectric element that operates according to a rising edge and a falling edge of the waveform becomes loose, tailing at the time of ejection, or ejection failure occurs, and thereby printing quality is decreased.

Meanwhile, if the frequency of self-excited oscillation is higher than 8 MHz, resolution of the waveform of the drive signal is enhanced. However, as the switching frequency of the transistor is increased, switching loss is increased, and power saving properties having superiority and heat removing properties are impaired, compared to linear amplification of a class AB amplifier or the like.

For this reason, it is preferable that, in the liquid ejecting apparatus, the frequency of the modulated signal is equal to or higher than 1 MHz and is equal to or lower than 8 MHz.

APPLICATION EXAMPLE 7

According to this application example, there is provided a head unit including: a modulation unit that generates a modulated signal which is obtained by pulse-modulating an original signal; a gate driver that generates an amplification control signal, based on the modulated signal; a transistor that generates an amplified and modulated signal which is obtained by amplifying the modulated signal, based on the amplification control signal; a low pass filter that generates a drive signal by demodulating the amplified and modulated signal; a piezoelectric element that is displaced by the drive signal which is applied; a first power supply unit that applies a signal to a terminal of the piezoelectric element, other than a terminal to which the drive signal is applied; a cavity which is filled with liquid therein, and whose internal volume is changed by displacement of the piezoelectric element; and a nozzle that communicates with the cavity, and ejects the liquid in the cavity as droplets in accordance with change of the internal volume of the cavity, in which the gate driver and the first power supply unit are connected to a common ground terminal.

According to the application example, since the gate driver and the first power supply unit are connected to the common ground terminal, in a case in which noise is superimposed on a ground potential, the noise that is superimposed on a signal which is applied to both terminals of the piezoelectric element is cancelled each other out. Therefore, a voltage that is applied to the piezoelectric element can be accurately controlled, and thus, it is possible to realize a head unit that can increase ejection accuracy of liquid.

APPLICATION EXAMPLE 8

According to this application example, there is provided an integrated circuit device for driving a capacitive load including: a modulation unit that generates a modulated signal which is obtained by pulse-modulating an original signal; a gate driver that generates an amplification control signal based on the modulated signal, and outputs the amplification control signal to an output circuit which generates a drive signal based on the amplification control signal and outputs the drive signal to a capacitive load; and a first power supply unit that applies a signal to a terminal of the capacitive load, other than a terminal to which the drive signal is applied, in which the gate driver and the first power supply unit are connected to a common ground terminal.

According to the application example, since the gate driver and the first power supply unit are connected to the common ground terminal, in a case in which noise is superimposed on a ground potential, the noise that is superimposed on a signal which is applied to both terminals of the piezoelectric element is cancelled each other out. Therefore, it is possible to realize an integrated circuit device for driving a capacitive load that can control a voltage that is applied to the capacitive load with high accuracy.

APPLICATION EXAMPLE 9

According to this application example, there is provided a capacitive load driving circuit including: a modulation unit that generates a modulated signal which is obtained by pulse-modulating an original signal; a gate driver that generates an amplification control signal, based on the modulated signal; a transistor that generates an amplified and modulated signal which is obtained by amplifying the modulated signal, based on the amplification control signal; a low pass filter that generates a drive signal by demodulating the amplified and modulated signal; a capacitive load to which the drive signal is applied; and a first power supply unit that applies a signal to a terminal of the capacitive load, other than a terminal to which the drive signal is applied, in which the gate driver and the first power supply unit are connected to a common ground terminal.

According to the application example, since the gate driver and the first power supply unit are connected to the common ground terminal, in a case in which noise is superimposed on a ground potential, the noise that is superimposed on a signal which is applied to both terminals of the piezoelectric element is cancelled each other out. Therefore, it is possible to realize an integrated circuit device for driving a capacitive load that can control a voltage that is applied to the capacitive load with high accuracy.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment according to the invention will be described in detail, using the drawings. The drawings are used for convenience of description. Embodiments that will be described below do not unduly limit the content of the invention described in the scope of Claims. In addition, all of the configurations that will be described below are not essential configuration requirements of the invention.

1. Overview of Liquid Ejecting Apparatus

A printing device that is an example of a liquid ejecting apparatus according to the present embodiment is an ink jet printer which ejects ink in accordance with image data which is supplied from an external host computer, thereby forming an ink dot group on a printing medium such as paper, and as a result, prints an image (includes characters, figures, or the like) according to the image data.

For example, a printing device such as a printer, a color material ejection device that is used for manufacturing a color filter, such as a liquid crystal display, an electrode material ejection device that is used for forming an electrode, such as an organic EL display or an FED (surface emitting display), a bio-organic material ejection device that is used for fabricating a bio-chip, or the like, can be used as a liquid ejecting apparatus.

Figure 1:
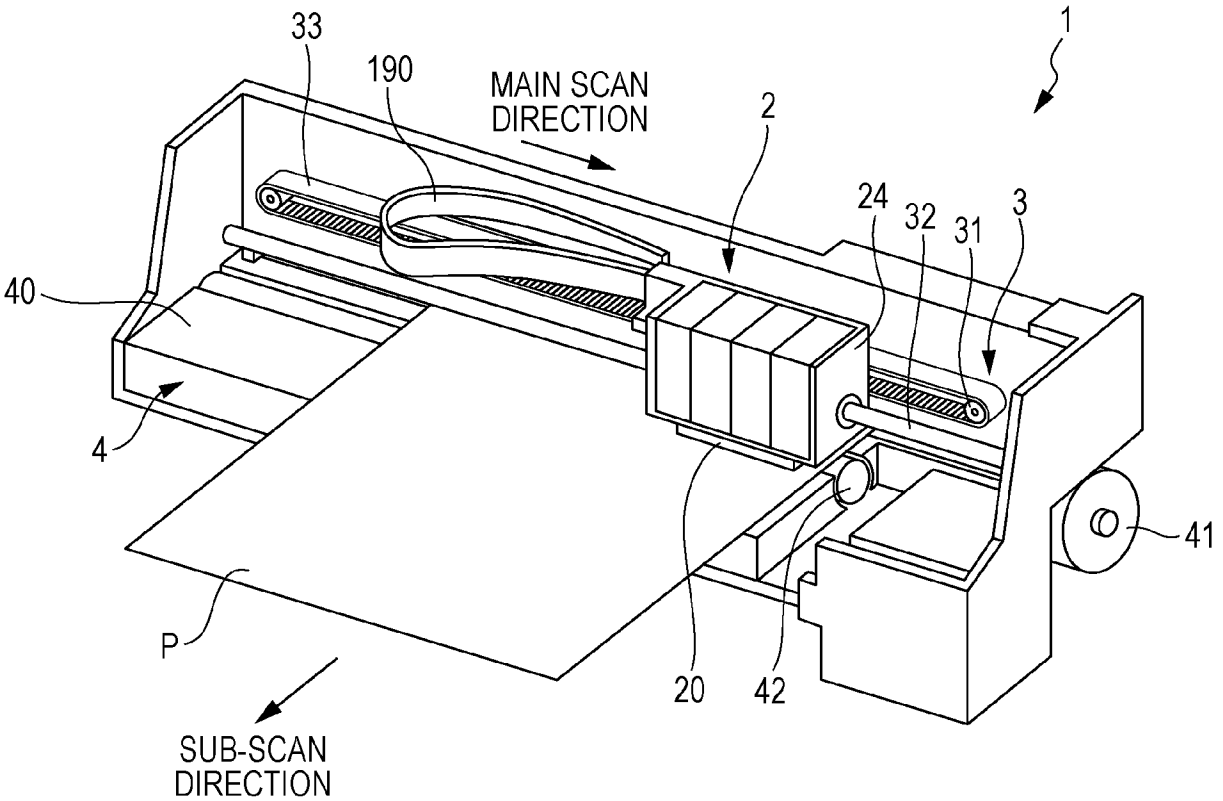
FIG. 1 is a view illustrating a schematic configuration of a liquid ejecting apparatus.

FIG. 1 is a perspective view illustrating a schematic configuration of the inside of a liquid ejecting apparatus 1. As illustrated in FIG. 1, the liquid ejecting apparatus 1 includes a moving mechanism 3 that moves (reciprocates) a moving body 2 in a main scan direction.

The moving mechanism 3 includes a carriage motor 31 that becomes a drive source of the moving body 2, a carriage guide shaft 32, and a timing belt 33 that extends substantially parallel to the carriage guide shaft 32 and is driven by the carriage motor 31.

A carriage 24 of the moving body 2 is reciprocably supported by the carriage guide shaft 32, and is fixed to a portion of the timing belt 33. For this reason, if the timing belt 33 travels forward and backward by the carriage motor 31, the moving body 2 is guided by the carriage guide shaft 32 thereby reciprocating.

In addition, in the moving body 2, a head unit 20 is provided in a portion that faces a printing medium P. As will be described later, the head unit 20 is used for ejecting ink droplets (liquid droplets) from multiple nozzles, and is configured to supply various control signals or the like via a flexible cable 190.

The liquid ejecting apparatus 1 includes a transport mechanism 4 that transports the printing medium P on a platen 40 in a sub-scan direction. The transport mechanism 4 includes a transport motor 41 that is a drive source, and a transport roller 42 that transports the printing medium P in the sub-scan direction by rotating by the transport motor 41.

At a timing in which the printing medium P is transported by the transport mechanism 4, the head unit 20 ejects ink droplets onto the printing medium P, and thereby an image is formed on the surface of the printing medium P.

Figure 2:
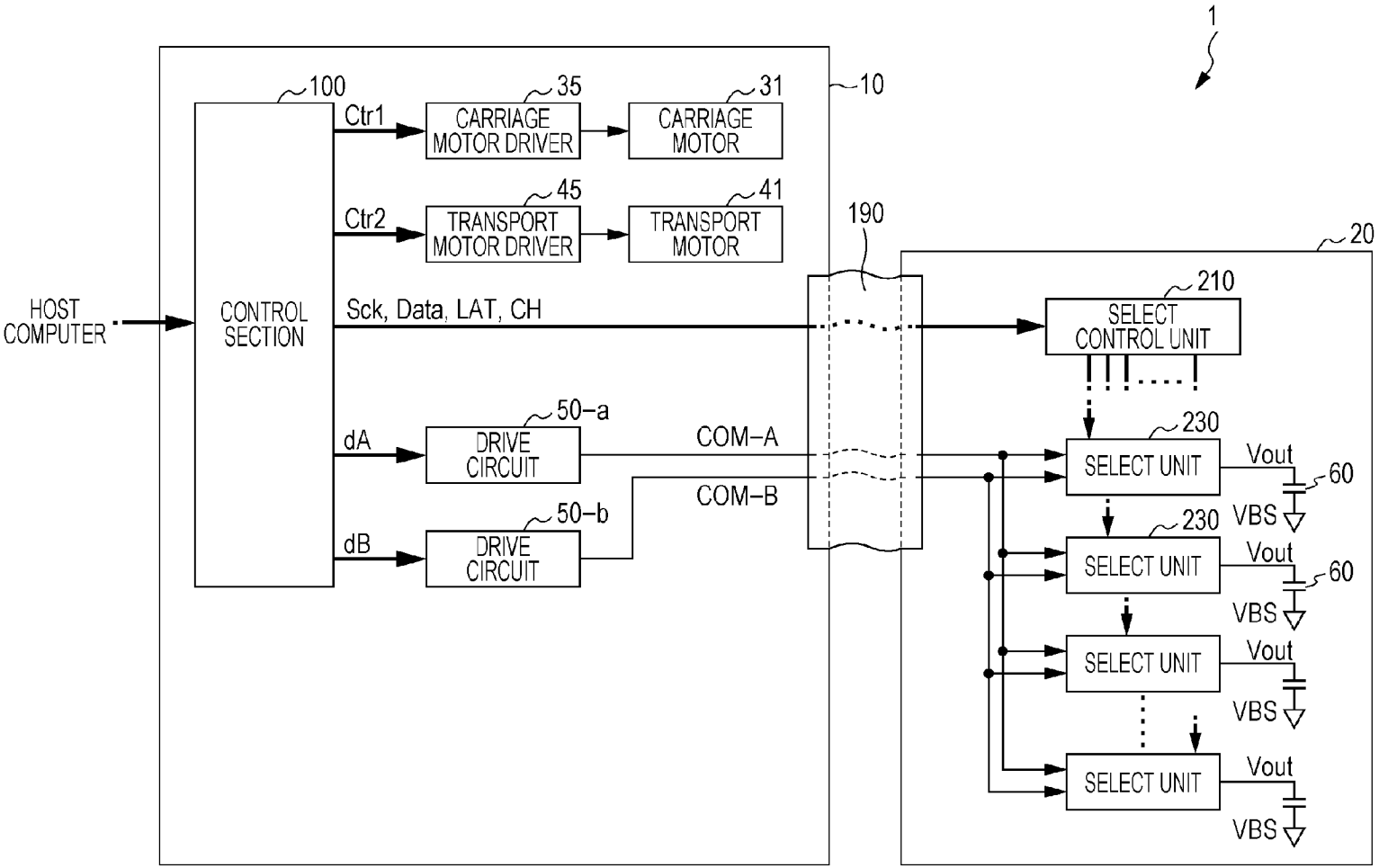
FIG. 2 is a block diagram illustrating a configuration of the liquid ejecting apparatus.

FIG. 2 is a block diagram illustrating an electrical configuration of the liquid ejecting apparatus 1.

As illustrated in this figure, in the liquid ejecting apparatus 1, a control unit 10 and the head unit 20 are coupled to each other via the flexible cable 190.

The control unit 10 includes a control section 100, the carriage motor 31, a carriage motor driver 35, the transport motor 41, a transport motor driver 45, a drive circuit 50-*a*, and a drive circuit 50-*b*. Among these, the control section 100 outputs various control signals for controlling the respective units, or the like, when image data is supplied from a host computer.

In detail, first, the control section 100 supplies a control signal Ctr1 to the carriage motor driver 35, the carriage motor driver 35 drives the carriage motor 31 according to the control signal Ctr1. According to this, movement of the carriage 24 in a main scan direction is controlled.

Second, the control section 100 supplies a control signal Ctr2 to the transport motor driver 45, and the transport motor driver 45 drives the transport motor 41 according to the control signal Ctr2. According to this, movement performed by the transport mechanism 4 in the sub-scan direction is controlled.

Third, the control section 100 supplies digital data dA to one drive circuit 50-*a* of the two drive circuits 50-*a* and 50-*b*, and supplies digital data dB to the other drive circuit 50-*b*. Here, the digital data dA defines a waveform of a drive signal COM-A, among drive signals that are supplied to the head unit 20, the data dB defines a waveform of a drive signal COM-B.

Detailed description will be made later, but the drive circuit 50-*a* performs an analog conversion of the data dA, and thereafter supplies the drive signal COM-A which is obtained by a class D amplification to the head unit 20. In the same manner, the drive circuit 50-*b* performs an analog conversion of the data dB, and thereafter supplies the drive signal COM-B which is obtained by a class D amplification to the head unit 20. In addition, the drive circuits 50-*a* and 50-*b* are only different from each other in that different data are input and different drive signals are output, and circuit configurations are the same as each other, as will be described later. For this reason, in a case in which it is not necessary to especially distinguish the drive circuits 50-*a* and 50-*b* (for example, in a case of describing FIG. 10 that will be described later), portions following "- (hyphen)" will be omitted, and description will be made by simply attaching a reference numeral "50".

Fourth, the control section 100 supplies a clock signal Sck, a data signal Data, and control signals LAT and CH to the head unit 20.

A plurality of sets of a select control unit 210, select units 230, and piezoelectric elements (piezo elements) 60, is provided in the head unit 20. As will be described later, the head unit 20 may include the drive circuits 50-*a* and 50-*b*.

The select control unit 210 informs the respective select units 230 which one of the drive signals COM-A and COM-B has to be selected (or none of which has to be selected), in accordance with a control signal or the like that is supplied from the control section 100. The select unit 230 selects one of the select signals COM-A and COM-B in accordance with an instruction of the select control unit 210, and supplies the selected signal to one terminal of the piezoelectric element 60 as a drive signal. In FIG. 2, a voltage of the signal is denoted by Vout. A voltage VBS is commonly applied to the other terminals of the respective piezoelectric elements 60.

The piezoelectric element 60 is displaced by the drive signal being applied. The piezoelectric elements 60 are provided in correspondence with each of the plurality of nozzles in the head unit 20. The piezoelectric element 60 is displaced in accordance with a difference between the voltage Vout of the drive signal selected by the select unit 230 and the voltage VBS, and thereby ink is ejected. Accordingly, a configuration in which the ink is ejected by driving the piezoelectric element 60 will be simply described.

Figure 3:
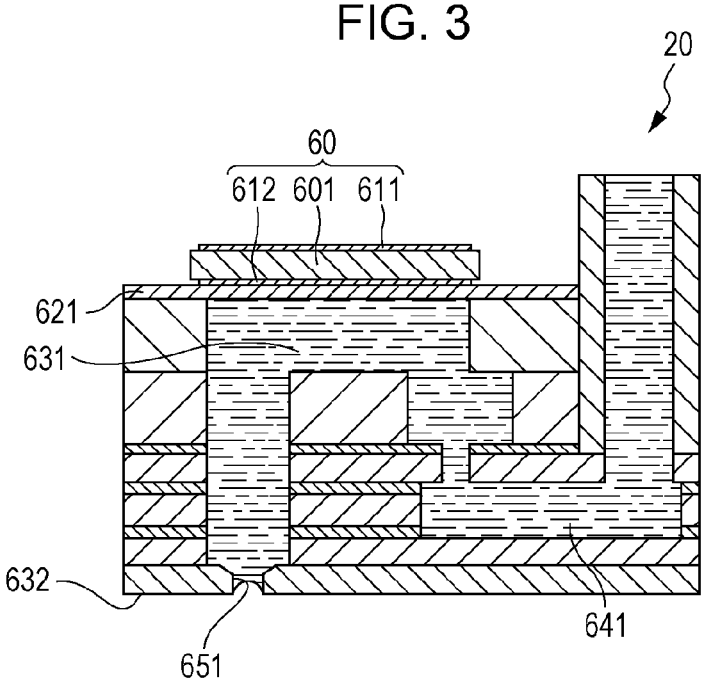
FIG. 3 is a view illustrating a configuration of an ejection unit in a head unit.

FIG. 3 illustrates a schematic configuration corresponding to one nozzle in the head unit 20.

As illustrated in FIG. 3, the head unit 20 includes the piezoelectric element 60, a vibration plate 621, a cavity (pressure chamber) 631, a reservoir 641, and a nozzle 651. Among these, the vibration plate 621 is displaced (bending vibration) by the piezoelectric element 60 provided on an upper surface in the figure, and functions as a diaphragm that expands and contracts an internal volume of the cavity 631 which is filled with ink. The nozzle 651 is provided in a nozzle plate 632, and is an opening section that communicates with the cavity 631. The inside of the cavity 631 is filled with liquid (for example, ink), and an internal volume is changed by the displacement of the piezoelectric element 60. The nozzle 651 communicates with the cavity 631, and ejects liquid droplets in the cavity 631 as liquid droplets, in accordance with the change of the internal volume of the cavity 631.

The piezoelectric element 60 illustrated in FIG. 3 has a structure in which a piezoelectric body 601 is interposed between a pair of electrodes 611 and 612. In the piezoelectric body 601 having the structure, the center portions of electrodes 611 and 612 and the vibration plate 621 in FIG. 3 is vertically bent with respect to both ends thereof, in accordance with a voltage that is applied by the electrodes 611 and 612. Specifically, the piezoelectric element 60 has a configuration in which, if the voltage Vout of the drive signal increases, the piezoelectric element 60 is bent upwards, and while, if the voltage Vout decreases, the piezoelectric element 60 is bent downwards. In this configuration, if the piezoelectric element 60 is bent upwards, the internal volume of the cavity 631 is expanded, and thereby the ink is taken in from the reservoir 641, while, if the piezoelectric element 60 is bent downwards, the internal volume of the cavity 631 is contracted, and thereby the ink is ejected from the nozzle 651, according to the degree of contraction.

The piezoelectric element 60 is not limited to the structure illustrated, and may be a shape which can eject liquid such as ink by deforming the piezoelectric element 60. In addition, the piezoelectric element 60 is not limited to bending vibration, and may have a configuration in which so-called longitudinal vibration is used.

In addition, the piezoelectric element 60 is provided in correspondence with the cavity 631 and the nozzle 651 in the head unit 20, and the piezoelectric element 60 is also provided in correspondence with the select unit 230 in FIG. 1. For this reason, the set of the piezoelectric element 60, the cavity 631, the nozzle 651, and the select unit 230 is provided in each nozzle 651.

Figure 4A:
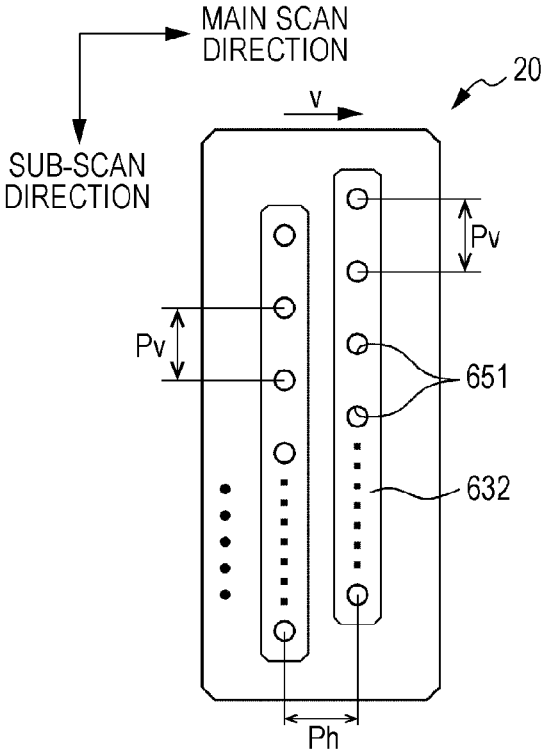
FIG. 4A and FIG. 4B are views illustrating a nozzle array in the head unit.

FIG. 4A is a view illustrating an example of an array of the nozzles 651.

As illustrated in FIG. 4A, the nozzles 651 are arranged in, for example, two columns as follows. In detail, from a viewpoint of one column, while the plurality of nozzles 651 are arranged at a pitch Pv along the sub-scan direction, each of two columns are separated by a pitch Ph in the main scan direction and are shifted by a half of the pitch Pv in the sub-scan direction.

In the nozzle 651, in a case in which color printing is performed, a color pattern corresponding to each color of cyan (C), magenta (M), yellow (Y), black (K), or the like is provided along, for example, the main scan direction. However, in the following description, a case of representing gradation in a single color will be described, for the sake of simplicity.

Figure 4B:
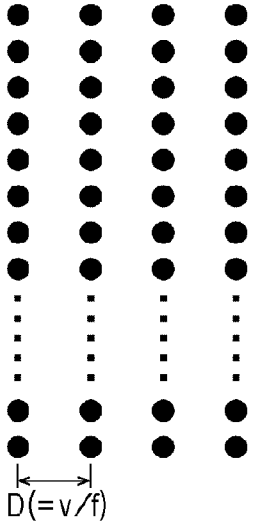

FIG. 4B is a diagram illustrating a basic resolution of an image formed by the nozzle arrangement illustrated in FIG. 4A. For the sake of simple description, this figure is an example of a method (first method) of forming one dot by ejecting ink droplets from the nozzle 651 once, and illustrates dots in which black round marks are formed by the landing of ink droplets.

When the head unit 20 moves at a velocity v in the main scan direction, as illustrated in the present figure, an interval D (in the main scan direction) of the dots that are formed by landing the ink droplets, and the velocity v have the following relationship.

That is, in a case in which one dot is formed by ejection of the ink droplets once, the dot interval D is expressed by a value that is obtained by dividing a velocity v by an ejection frequency f of the ink (=v/f), in other words, by a distance that the head unit 20 moves during a cycle (1/f) in which the ink droplets are repeatedly ejected.

In the example of FIG. 4A and FIG. 4B, a relationship is established in which the pitch Ph is proportional by a coefficient n with respect to dot interval D, the ink droplets that are ejected from the nozzles 651 of two columns land so as to be aligned in the same column on the printing medium P. For this reason, as illustrated in FIG. 4B, the dot interval in the sub-scan direction is a half of the dot interval in the main scan direction. It is needless to say that the arrangement of the dots is not limited to the illustrated example.

Here, in order to realize high-speed printing, simply, the velocity v by which the head unit 20 moves in the main scan direction may be increased. However, a simple increase of the velocity v causes the interval of the dot to be elongated. For this reason, after a certain degree of resolution is ensured, in order to realize high-speed printing, it is necessary to increase the ejection frequency of the ink and to increase the number of dots that are formed per unit time.

In addition, differently from the printing speed, in order to increase a resolution, the number of dots that are formed per unit time may be increased. However, in a case of increasing the number of dots, if the ink is not a small amount, adjacent dots are bound to each other, and if the ejection frequency f of the ink does not become higher, printing speed is decreased.

In this way, in order to realize high-speed printing and high-resolution printing, it is necessary to increase the ejection frequency f of the ink, as described above.

Meanwhile, in addition to a method of forming one dot by ejecting the ink droplets once, as a method of forming dots on the printing medium P, there is a method (second method) of forming one dot, by enabling the ink droplets to be ejected twice or more during a unit period, landing one or more ink droplets ejected during the unit period, and coupling the one or more ink droplets that landed, or there is a method (third method) of forming two or more dots without coupling the two or more ink droplets. In the following description, a case in which dots are formed by the second method will be described.

In the present embodiment, the second method will be described by assuming the following example. That is, in the present embodiment, the ink is ejected twice to the greatest extent for one dot, and thus four gradations of a large dot, a medium dot, a small dot, and non-recording are represented. In the present embodiment, in order to represent the four gradations, two types of drive signals COM-A and COM-B are provided, and each has a first half pattern and a second half pattern during one cycle. During one cycle, the drive signals COM-A and COM-B are supplied to the piezoelectric elements 60 in the first half and the second half, in accordance with selection (or non-selection) according to gradation to be represented.

Here, the drive signals COM-A and COM-B will be described, and thereafter, a configuration for selecting the drive signals COM-A and COM-B will be described. The drive signals COM-A and COM-B are respectively generated by a drive circuit 50, and the drive circuit 50 will be described after a configuration for selecting the drive signals COM-A and COM-B, for convenience.

Figure 5:
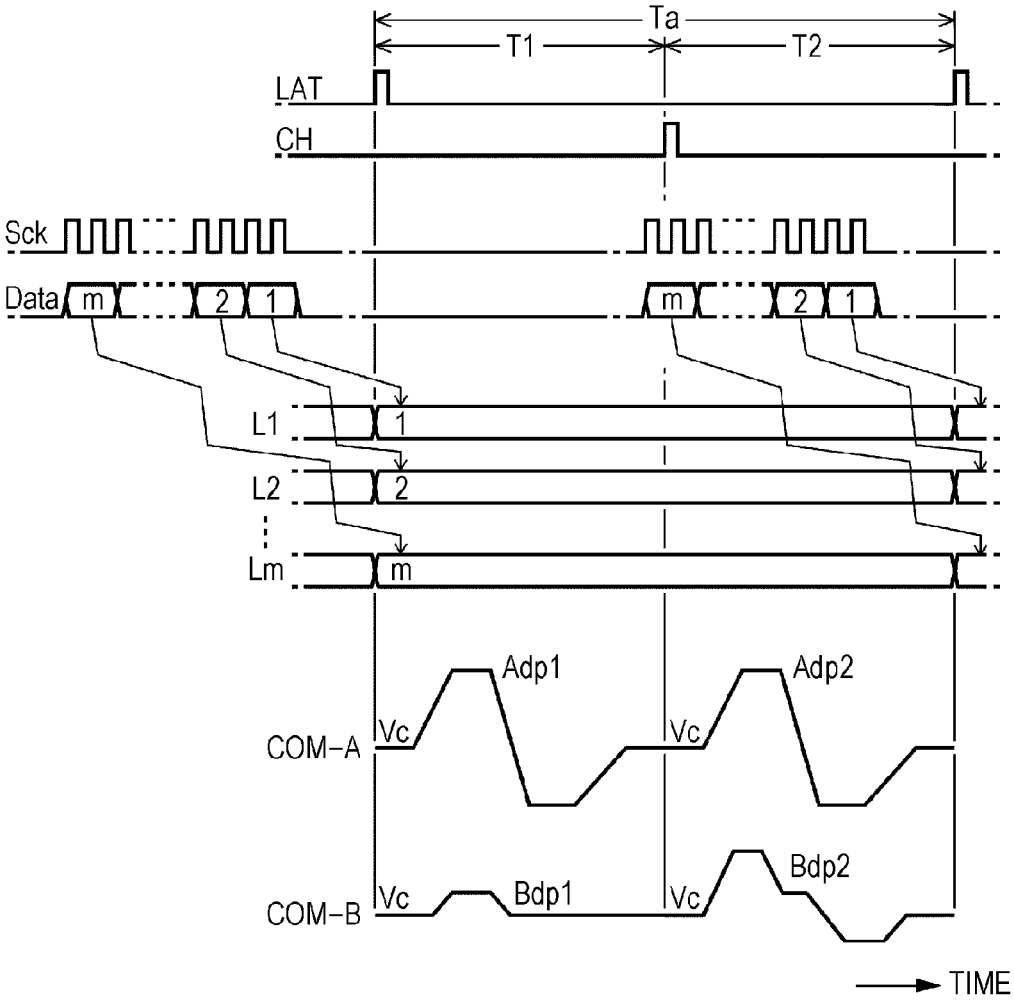
FIG. 5 is a diagram illustrating an operation of a select control unit in the head unit.

FIG. 5 is a diagram illustrating waveforms or the like of the drive signals COM-A and COM-B.

As illustrated in FIG. 5, the drive signal COM-A has a waveform in which a trapezoidal waveform Adp1 that is disposed in a cycle T1 from a time point in which a control signal LAT is output (rises) to a time point in which a control signal CH is output, among a printing cycle Ta, is coupled to a trapezoidal waveform Adp2 that is disposed in a period T2 from a time point in which the control signal CH is output (rises) to a time point in which the control signal LAT is output, among the printing period Ta.

In the present embodiment, the trapezoidal waveforms Adp1 and Adp2 are approximately the same waveforms as each other, and if supplied to the one terminals of the piezoelectric elements 60, the trapezoidal waveforms make the ink of a predetermined amount, specifically, an approximately medium amount be respectively ejected from the nozzles 651 corresponding to the piezoelectric elements 60.

The drive signal COM-B is a waveform in which a trapezoidal waveform Bdp1 that is disposed in the period T1 is coupled to a trapezoidal waveform Bdp2 that is disposed in a period T2. In the present embodiment, the trapezoidal waveforms Bdp1 and Bdp2 are waveforms different from each other. Among the trapezoidal waveforms Bdp1 and Bdp2, the trapezoidal waveform Bdp1 is a wave that prevents viscosity of the ink from increasing, by performing micro-vibration of the ink in the vicinity of an opening of the nozzle 651. For this reason, even if the trapezoidal waveform Bdp1 is supplied to one terminal of the piezoelectric element 60, the ink is not ejected from the nozzle 651 corresponding to the piezoelectric element 60. In addition, the trapezoidal waveform Bdp2 is a waveform different from the trapezoidal waveform Adp1 (Adp2). If supplied to the one terminal of the piezoelectric elements 60, the trapezoidal waveform Bdp2 makes the ink of an amount smaller than the predetermined amount be ejected from the nozzle 651 corresponding to the piezoelectric element 60.

A voltage at a start timing of the trapezoidal waveforms Adp1, Adp2, Bdp1, and Bdp2, and a voltage at an end timing are all a voltage Vc in common. That is, the trapezoidal waveforms Adp1, Adp2, Bdp1, and Bdp2 respectively start at the voltage Vc, and end at the voltage Vc.

Figures 6, 7:
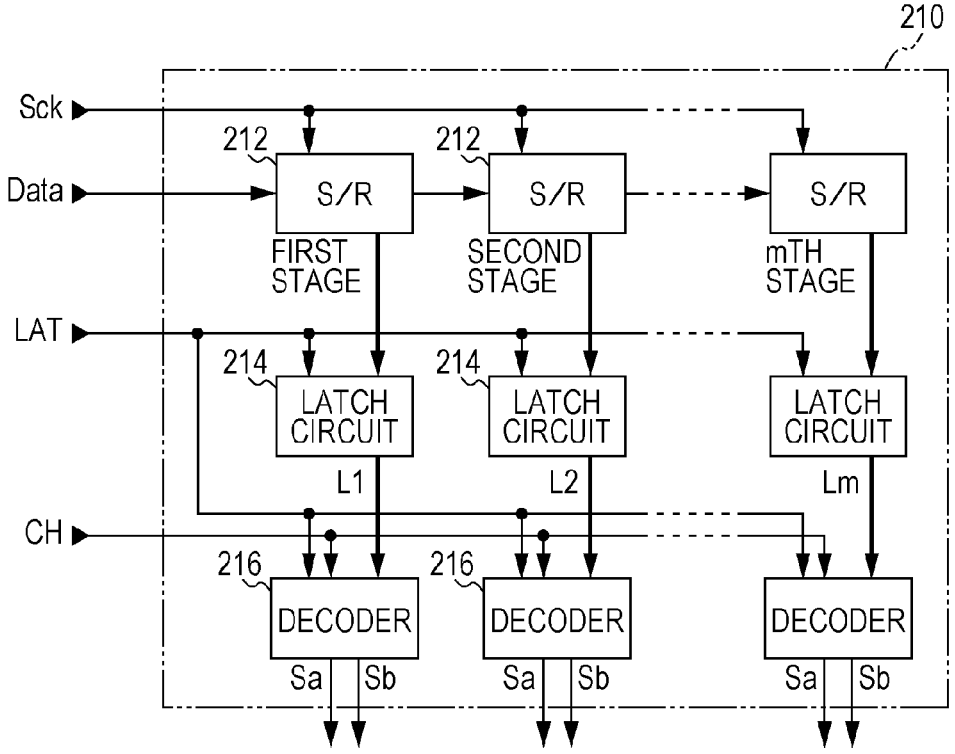
FIG. 6 is a diagram illustrating a configuration of the select control unit in the head unit.
FIG. 7 is a diagram illustrating decoding content of a decoder in the head unit.

FIG. 6 is a diagram illustrating a configuration of the select control unit 210 in FIG. 2.

As illustrated in FIG. 6, the select control unit 210 receives a clock signal Sck, a data signal Data, and the control signals LAT and CH from the control unit 10. A set of shift registers (S/R) 212, latch circuits 214, and decoders 216 is provided in the select control unit 210, in correspondence with each of the piezoelectric elements 60 (the nozzles 651).

The data signal Data defines the size of an image, when one dot of the image is formed. In the present embodiment, in order to represent four gradations of non-recording, a small dot, a medium dot, and a large dot, the data signal Data is configured by two bits of a high level bit (MSB) and a low level bit (LSB).

The data signals Data are serially supplied from the control section 100 in synchronization with the clock signal Sck, in accordance with a main scan of the head unit 20, for each nozzle. The shift register 212 retains once two bits of the data signals Data that are serially supplied, in correspondence with the nozzles.

In detail, the shift registers 212 of stage correspondence to the piezoelectric elements 60 (nozzles) are cascaded to each other, and the data signals Data are serially transferred to a subsequent stage in accordance with the clock signal Sck.

When the number of the piezoelectric elements 60 is referred to as m (m is two or more), in order to distinguish the shift registers 212, stages are denoted by a first stage, a second stage, . . . , and an mth stage sequentially from an upstream side on which the data signals Data are supplied.

The latch circuit 214 latches the data signal Data retained in the shift register 212 in accordance to a rising edge of the control signal LAT.

The decoder 216 decodes the data signal Data of two bits that is latched by the latch circuit 214, outputs select signals Sa and Sb for each of the periods T1 and T2 defined by the control signal LAT and the control signal CH, and defines selection of the select unit 230.

FIG. 7 is a diagram illustrating decoding content of the decoder 216.

In FIG. 7, the data signal Data of two bits that is latched is denoted by MSB and LSB. For example, if the latched data signal Data is 0 and 1, the decoder 216 makes logic levels of the select signals Sa and Sb respectively go to an H level and an L level during the period T1, and respectively go to an L level and an H level during the period T2.

The logic levels of the select signals Sa and Sb are shifted to a high amplitude logic level higher than the logic levels of the clock signal Sck, the data signal Data, and the control signals LAT and CH, by a level shifter (not illustrated).

Figure 8:
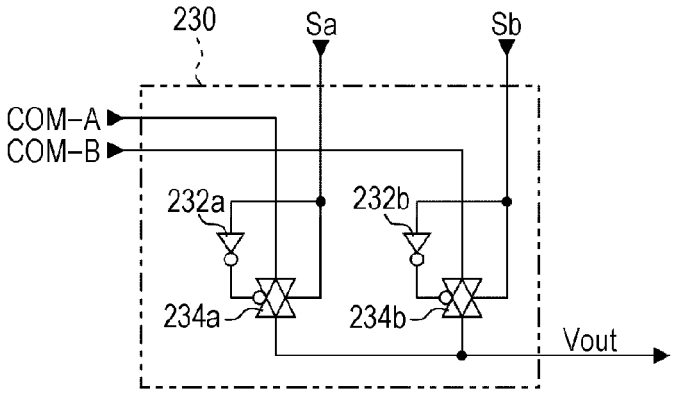
FIG. 8 is a diagram illustrating a configuration of a select unit in the head unit.

FIG. 8 is a diagram illustrating a configuration of the select unit 230 corresponding to one of the piezoelectric elements 60 (nozzles 651) in FIG. 2.

As illustrated in FIG. 8, the select unit 230 includes inverters (NOT circuit) 232*a* and 232*b*, and transfer gates 234*a* and 234*b*.

While the select signal Sa from the decoder 216 is supplied to a positive control terminal of the transfer gate 234*a* to which a round mark is not attached, the select signal Sa is inverted by the inverter 232*a* and is supplied to a negative control terminal of the transfer gate 234*a* to which a round mark is attached. In the same manner, while the select signal Sb is supplied to a positive control terminal of the transfer gate 234*b*, the select signal Sb is inverted by the inverter 232*b* and is supplied to a negative control terminal of the transfer gate 234*b*.

The drive signal COM-A is supplied to an input terminal of the transfer gate 234*a*, and the drive signal COM-B is supplied to an input terminal of the transfer gate 234*b*. Output terminals of the transfer gates 234*a* and 234*b* are connected to each other, and are connected to one terminal of the corresponding piezoelectric element 60.

If the select signal Sa goes to an H level, the input terminal and the output terminal of the transfer gate 234*a* are connected (on) to each other, and if the select signal Sa goes to an L level, the input terminal and the output terminal of the transfer gate 234*a* are disconnected (off) from each other. The input terminal and the output terminal of the transfer gate 234*b* are also turned on or off according to the select signal Sb, in the same manner as the transfer gate 234*a*.

Next, operations of the select control unit 210 and the select unit 230 will be described with reference to FIG. 5.

The data signals Data are serially supplied from the control section 100 for each nozzle, in synchronization with the clock signal Sck, and are sequentially transferred to the shift register 212 corresponding to the nozzle. Thus, if the control section 100 stops supply of the clock signal Sck, the data signals Data corresponding to the nozzles are retained in the respective shift registers 212. The data signals Data are supplied in sequence corresponding to the nozzles of the last m stage, . . . , the second stage, and the first stage of the shift registers 212.

Here, if the control signal LAT rises, each of the latch circuits 214 integrally latches the data signals Data retained in the shift registers 212. In FIG. 5, L1, L2, . . . , and Lm indicate the data signals Data that are latched by the latch circuits 214 corresponding to the shift registers 212 of the first stage, the second stage, . . . , and the mth stage.

The decoders 216 output the levels of the select signals Sa and Sb in the same manner as the content illustrated in FIG. 7 during the respective periods T1 and T2, in accordance with the size of the dots defined by the latched data signals Data.

That is, first, in a case of defining the size of a large dot when the data signal Data is (1,1), the decoder 216 sets the select signals Sa and Sb to an H level and an L level during the period T1, and sets the select signals Sa and Sb to an H level and an L level during the period T2. Second, in a case of defining the size of a middle dot when the data signal Data is (0,1), the decoder 216 sets the select signals Sa and Sb to an H level and an L level during the period T1, and sets the select signals Sa and Sb to an L level and an H level during the period T2. Third, in a case of defining the size of a small dot when the data signal Data is (1,0), the decoder 216 sets the select signals Sa and Sb to an L level and an L level during the period T1, and sets the select signals Sa and Sb to an L level and an H level during the period T2. Fourth, in a case of defining non-recording when the data signal Data is (0,0), the decoder 216 sets the select signals Sa and Sb to an L level and an H level during the period T1, and sets the select signals Sa and Sb to an L level and an L level during the period T2.

Figure 9:
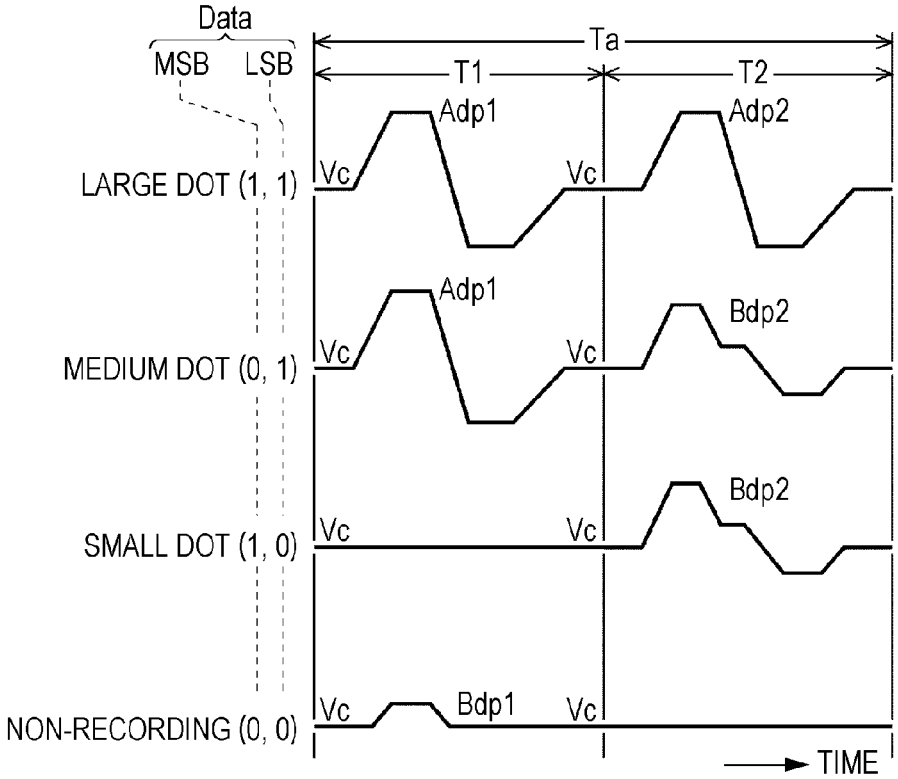
FIG. 9 is a diagram illustrating a drive signal that is selected by the select unit.

FIG. 9 is a diagram illustrating voltage waveforms of the drive signal that is selected by the select unit, and is supplied to one terminal of the piezoelectric element 60.

When the data signal Data is (1,1), the select signals Sa and Sb respectively go to an H level and an L level during the period T1, and thereby the transfer gate 234*a* is turned on and the transfer gate 234*b* is turned off. For this reason, the trapezoidal waveform Adp1 of the drive signal COM-A is selected during the period T1. The select signals Sa and Sb respectively go to an H level and an L level during the period T2, and thereby the select unit 230 selects the trapezoidal waveform Adp2 of the drive signal COM-A.

In this way, if the trapezoidal waveform Adp1 is selected during the period T1, the trapezoidal waveform Adp2 is selected during the period T2, and the selected signal is supplied to one terminal of the piezoelectric elements 60 as a drive signal, the ink of an approximately medium amount is ejected twice from the nozzle 651 corresponding to the piezoelectric element 60. For this reason, each ink lands on the printing medium P and then are combined with each other. As a result, a large dot is formed as defined by the data signal Data.

When the data signal Data is (0,1), the select signals Sa and Sb respectively go to an H level and an L level during the period T1, and thereby the transfer gate 234*a* is turned on and the transfer gate 234*b* is turned off. For this reason, the trapezoidal waveform Adp1 of the drive signal COM-A is selected during the period T1. Subsequently, the select signals Sa and Sb respectively go to an L level and an H level during the period T2, and thereby the trapezoidal waveform Bdp2 of the drive signal COM-B is selected.

Thus, the ink of an approximately medium amount is ejected twice from the nozzle 651 corresponding to the piezoelectric element 60. For this reason, each ink lands on the printing medium P and then are combined with each other. As a result, a medium dot is formed as defined by the data signal Data.

When the data signal Data is (1,0), both the select signals Sa and Sb go to an L level during the period T1, and thereby the transfer gates 234*a* and 234*b* are turned off. For this reason, none of the trapezoidal waveforms Adp1 and Bdp1 are selected during the period T1. In a case in which the transfer gates 234*a* and 234*b* are turned off together, a path from a connection point of the output terminals of the transfer gates 234*a* and 234*b* to one terminal of the piezoelectric elements 60 enters a high impedance state which is a state in which the path is electrically disconnected from all portions. However, the piezoelectric elements 60 retain a voltage (Vc-VBS) which is a voltage immediately before the transfer gates 234*a* and 234*b* are turned off, because of a capacitance included in the piezoelectric elements 60.

Subsequently, both the select signals Sa and Sb go to an H level during the period T2, and thereby the trapezoidal waveform Bdp2 of the drive signal COM-B is selected. For this reason, the ink of an approximately small amount is ejected from the nozzle 651, only during the period T2, and thereby a small dot is formed on the printing medium P, as defined by the data signal Data.

When the data signal Data is (0,0), the select signals Sa and Sb respectively go to an L level and an H level during the period T1, and thereby the transfer gate 234*a* is turned off and the transfer gate 234*b* is turned on. For this reason, the trapezoidal waveform Bdp1 of the drive signal COM-B is selected during the period T1. Subsequently, both the select signals Sa and Sb respectively go to an L level during the period T2, and thereby none of the trapezoidal waveforms Adp2 and Bdp2 are selected.

For this reason, since the ink in the vicinity of an opening of the nozzle 651 performs micro-vibration during the period T1 and the ink is not ejected, as a result, the dot is not formed, that is, non-recording is done, as defined by the data signal Data.

In this way, the select unit 230 selects (or does not select) the drive signals COM-A and COM-B in accordance with an instruction from the select control unit 210, and supplies the selected signal to one terminal of the piezoelectric element 60. For this reason, the piezoelectric element 60 is driven in accordance with the size of a dot which is defined by the data signal Data.

The drive signals COM-A and COM-B illustrated in FIG. 5 are just an example. Actually, a combination of various waveforms which is provided in advance is used in accordance with the moving speed of the head unit 20 or the properties of the printing medium P.

In addition, here, the piezoelectric elements 60 are described by using an example in which the piezoelectric element 60 is bent upwards in accordance with an increase of a voltage, but if a voltage that is supplied to the electrode 611 and 612 is inverted, the piezoelectric element 60 is bent downwards in accordance with an increase of the voltage. For this reason, in a configuration in which the piezoelectric elements 60 are bent downwards in accordance with an increase of a voltage, the drive signals COM-A and COM-B that are illustrated in FIG. 9 have waveforms that are inverted based on the voltage Vc.

In this way, in the present embodiment, one dot is formed by using a cycle Ta that is a unit period as a unit, with respect to the printing medium P. For this reason, in the present embodiment in which one dot is formed by ejection of the ink droplets twice (maximum) during the cycle Ta, the ejection frequency f of the ink becomes 2/Ta, and the dot interval D has a value that is obtained by dividing the velocity v by which the head unit 20 moves by the ejection frequency f (=2/Ta) of the ink.

In general, the ink droplets can be ejected by Q (Q is an integer equal to or greater than 2) times during the unit time T, and in a case in which one dot is formed by ejection of the ink droplets Q times, the ejection frequency f of the ink can be expressed as Q/T.

As described in the present embodiment, in a case in which dots having sizes different from each other are formed on the printing medium P, it is necessary to reduce a time for ejecting the ink droplets once, even if times (cycles) required for forming one dot are the same, compared to a case in which one dot is formed by ejection of the ink droplets once.

Special description for a third method of forming two or more dots without binding two or more ink droplets will not be required.

2. Circuit Configuration of Drive Circuit

Subsequently, the drive circuits 50-*a* and 50-*b* will be described. Schematically, one drive circuit 50-*a* of these generates the drive signal COM-A as follows. That is, first, the drive circuit 50-*a* converts data dA that is supplied from the control section 100 into an analog signal. Second, the drive circuit 50-*a* feeds back the drive signal COM-A that is output, corrects deviation between a signal (attenuation signal) and a target signal using high-frequency components of the drive signal COM-A, based on the drive signal COM-A, and generates a modulated signal according to the corrected signal. Third, the drive circuit 50-*a* generates an amplified ad modulated signal by a switching transistor in accordance with the modulated signal. Fourth, the drive circuit 50-*a* smooths (demodulates) the amplified and modulated signal using a low pass filter, and outputs the smoothed signal as the drive signal COM-A.

The other drive circuit 50-*b* also has the same configuration, and is different from the drive circuit 50-*a* in a point in which the drive signal COM-B is output from the data dB. Thus, in FIG. 10 below, the drive circuits 50-*a* and 50-*b* are not distinguished from each other, and will be described as one drive circuit 50.

Here, data that is input or a drive signal that is output will be referred to as dA (dB), COM-A (COM-B), or the like. Also it will be referred to that the drive circuit 50-*a* inputs the data dA and outputs the drive signal COM-A, and the drive circuit 50-*b* inputs the data dB and outputs the drive signal COM-B.

Figure 10:
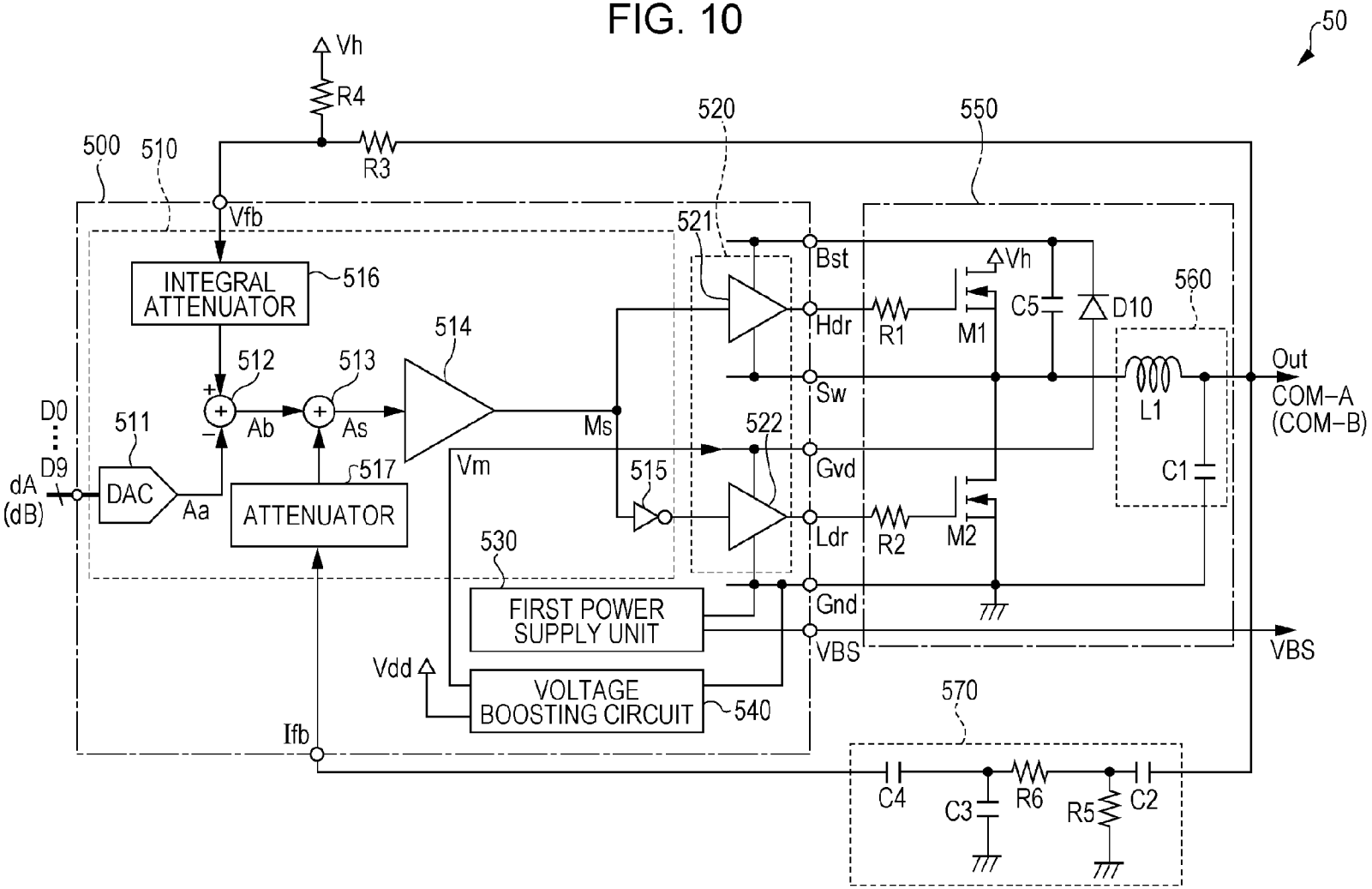
FIG. 10 is a diagram illustrating a circuit configuration of a drive circuit (capacitive load driving circuit).

FIG. 10 is a diagram illustrating a circuit configuration of the drive circuit (capacitive load driving circuit) 50.

FIG. 10 illustrates a configuration for outputting the drive signal COM-A, but, actually, in an integrated circuit 500, a circuit for generating both the drive signals COM-A and COM-B of two type is integrated as one package.

As illustrated in FIG. 10, the drive circuit 50 is configured by various types of elements such as resistors or capacitors, in addition to the integrated circuit device (integrated circuit device for driving a capacitive load) 500 and an output circuit 550.

The drive circuit 50 according to the present embodiment includes a modulation unit 510 that generates a modulated signal by pulse-modulating an original signal, a gate driver 520 that generates an amplified control signal, based on the modulated signal, transistors (a first transistor M1 and a second transistor M2) that generate the amplified and modulated signals which are obtained by amplifying the modulated signals, based on the amplified control signal, a low pass filter 560 that generates a drive signal by demodulating the amplified and modulated signal, and a first power supply unit 530 that applies signals to terminals of the piezoelectric elements 60, other than the terminals to which the drive signals are applied.

The integrated circuit device 500 according to the present embodiment includes a modulation unit 510 and a gate driver 520.

The integrated circuit device 500 outputs gate signals (amplified control signals) to each of the first transistor M1 and the second transistor M2, based on the data dA (original signal) of 10 bits that is input from the control section 100 via terminals D0 to D9. For this reason, the integrated circuit device 500 includes a digital to analog converter (DAC) 511, an adder 512, an adder 513, a comparator 514, an integral attenuator 516, an attenuator 517, an inverter 515, a first gate driver 521, a second gate driver 522, a first power supply unit 530, and a voltage boosting circuit 540.

The DAC 511 converts the data dA that defines a waveform of the drive signal COM-A into an analog signal Aa, and supplies the analog signal to an input terminal (−) of the adder 512. A voltage amplitude of the analog signal Aa is, for example, approximately 0 volt to 2 volts, and a signal that is obtained by amplifying the voltage by approximately 20 times becomes the drive signal COM-A. That is, the analog signal Aa is a target signal before the drive signal COM-A is amplified.

The integral attenuator 516 attenuates a voltage of a terminal Out that is input via a terminal Vfb, that is, the drive signal COM-A, integrates, and supplies the integrated signal to an input terminal (+) of the adder 512.

The adder 512 supplies a signal Ab of a voltage that is obtained by subtracting a voltage of the input terminal (+) from a voltage of the input terminal (−) and integrating the voltage, to one of input terminals of the adder 513.

A power supply voltage of a circuit from the DAC 511 to the inverter 515 is 3.3 volts (voltage Vdd) with a low amplitude. For this reason, there is a case in which, while the voltage of the analog signal Aa is a maximum of approximately two volts, the voltage of the drive signal COM-A exceeds a maximum of 40 volts. Thereby, in order to match the amplitude ranges of both voltages when calculating deviation, the voltage of the drive signal COM-A is attenuated by the integral attenuator 516.

The attenuator 517 attenuates frequency components of the drive signals COM-A that is input via a terminal Ifb, and supplies the attenuated frequency components to the other input terminals of the adder 513. The adder 513 supplies a signal As of a voltage that is obtained by adding a voltage of one input terminal to a voltage of the other input terminal, to the comparator 514. Attenuation that is performed by the attenuator 517 is for matching amplitudes, when the drive signal COM-A is fed back, in the same manner as in the integral attenuator 516.

A voltage of the signal As that is output from the adder 513 is obtained by subtracting the voltage of the analog signal Aa from an attenuation voltage of a signal that is supplied to a terminal Vfb, and then adding an attenuation voltage of a signal that is supplied to the terminal Ifb. For this reason, it can be said that the voltage of the signal As obtained by the adder 513 is a signal that is obtained by correcting deviation which is obtained by subtracting the voltage of the analog signal Aa that is a target from an attenuation voltage of the drive signal COM-A that is output from the terminal Out, using the high frequency components of the drive signal COM-A.

The comparator 514 outputs a modulation signal Ms that is obtained by pulse-modulating as follows, based on the voltage added by the adder 513. In detail, if the voltage of the signal As that is output from the adder 513 rises, when the voltage is equal to or higher than a threshold voltage Vth1, the comparator 514 outputs a modulation signal Ms of an H level, and if the voltage of the signal As that is output from the adder 513 falls, when the voltage is lower than a threshold voltage Vth2, the comparator 514 outputs the modulation signal Ms of an L level. As will be described later, the threshold voltages are set so as to have a relationship of Vth1>Vth2.

The modulation signal Ms that is obtained by the comparator 514 is logically inverted by the inverter 515 and is supplied to the second gate driver 522. Meanwhile, the first gate driver 521 receives the modulation signal Ms that is not logically inverted. For this reason, the logic levels of the signals that are supplied to the first gate driver 521 and the second gate driver 522 have an exclusive relationship with each other.

Timing may be controlled, in such a manner that the logic levels of the signals that are supplied to the first gate driver 521 and the second gate driver 522 do not become actually and simultaneously an H level (in such a manner that the first transistor M1 and the second transistor M2 are not simultaneously turned on). For this reason, here, being exclusive means not simultaneously becoming an H level (the first transistor M1 and the second transistor M2 are not simultaneously turned on), strictly speaking.

Here, the modulation signal is the modulation signal Ms in a narrow sense, but if the modulation signal is considered to be pulse-modulated in accordance with the analog signal Aa, a negative signal of the modulation signal Ms is also include in the modulation signal. That is, the modulation signal that is pulse-modulated in accordance with the analog signal Aa includes not only the modulation signal Ms, but also a signal that is obtained by inverting the logic level of the modulation signal Ms or a signal whose timing is controlled.

Since the comparator 514 outputs the modulation signal Ms, a circuit from the input terminals to the source line control circuit 514 or the inverter 515, that is, the DAC 511, the adder 512, the adder 513, the comparator 514, the inverter 515, the integral attenuator 516, and the attenuator 517 correspond to the modulation unit 510 that generates the modulation signal.

In addition, in the configuration illustrated in FIG. 10, the digital data dA is converted into the analog signal Aa by the DAC 511, but the analog signal Aa may be supplied from an external circuit, for example in accordance with an instruction of the control section 100, without passing through the DAC 511. Regardless of whether it is the digital data dA or the analog signal Aa, the signal defines a target value for generating the waveform of the drive signal COM-A, and thus the fact that the signal is an original is not changed.

The first gate driver 521 shifts the level of the output signal of the comparator 514 from a low logic amplitude to a high logic amplitude, and outputs the signal from a terminal Hdr. Among the power supply voltages of the first gate driver 521, a high potential is a voltage that is applied via a terminal Bst, and a low potential is a voltage that is applied via a terminal Sw. The terminal Sw is connected to a source electrode of the first transistor M1, a drain electrode of the second transistor M2, the other terminal of a capacitor C5, and one terminal of an inductor L1.

The second gate driver 522 operates with a voltage lower than the first gate driver 521. The second gate driver 522 shifts the level of the output signal of the comparator 514 from a low logic amplitude (L level: 0 volts, H level: 3.3 volts) to a high logic amplitude (for example, L level: 0 volts, H level: 7.5 volts), and outputs the signal from a terminal Ldr. Among the power supply voltages of the second gate driver 522, a voltage Vm (for example, 7.5 volts) is applied to a high potential side, and a voltage of zero volt is applied to a low potential side via a ground terminal Gnd. In addition, a terminal Gvd is connected to an anode electrode of a diode D10 for reverse flow prevention, a cathode electrode of the diode D10 is connected to one terminal of a capacitor C5 and the terminal Bst.

The first transistor M1 and the second transistor M2 are, for example, N channel type field effect transistors (FET). Among these, in the first transistor M1 on a high side, a voltage Vh (for example, 42 volts) is applied to a drain electrode, and a gate electrode is connected to the terminal Hdr via a resistor R1. In the second transistor M2 on a low side, a gate electrode is connected to the terminal Ldr via a resistor R2, and a source electrode is connected to the ground.

The other terminal of the inductor L1 is the terminal Out that is an output of the drive circuit 50, and the drive signal COM-A is supplied to the head unit 20 from the terminal Out via the flexible cable 190 (refer to FIG. 1 and FIG. 2).

The terminal Out is connected to one terminal of a capacitor C1, one terminal of a capacitor C2, and one terminal of a resistor R3. Among these, the other terminal of the capacitor C1 is connected to the ground. For this reason, the inductor L1 and the capacitor C1 function as a low pass filter that smooths an amplified and modulated signal appearing at a connection point of the first transistor M1 and the second transistor M2.

The other terminal of a resistor R3 is connected to the terminal Vfb and one terminal of a resistor R4, and the voltage Vh is applied to the other terminal of the resistor R4. According to this, the drive signal COM-A from the terminal Out is pulled up and fed back to the terminal Vfb.

Meanwhile, the other terminal of the capacitor C2 is connected to one terminal of a resistor R5 and one terminal of a resistor R6. Among these, the other terminal of the resistor R5 is connected to the ground. For this reason, the capacitor C2 and the resistor R5 function as a high pass filter that makes high frequency components equal to or higher than a cutoff frequency pass through, in the drive signal COM-A from terminal Out. The cutoff frequency of the high pass filter is set to, for example, 9 MHz.

In addition, the other terminal of the resistor R6 is connected to one terminal of a capacitor C4 and one terminal of a capacitor C3. Among these, the other terminal of the capacitor C3 is connected to the ground. For this reason, the resistor R6 and the capacitor C3 function as a low pass filter that makes low frequency components equal to or lower than the cutoff frequency pass through, among the signal components that pass the high pass filter. The cutoff frequency of the LPF is set to, for example, 160 MHz.

The cutoff frequency of the high pass filter is set to a frequency lower than the cutoff frequency of the low pass filter, and thus, the high pass filter and the low pass filter function as a band pass filter 570 that makes high frequency components of a predetermined frequency bandwidth pass through, in the drive signal COM-A.

The other terminal of the capacitor C4 is connected to the terminal Ifb of the integrated circuit device 500. According to this, DC components among the high frequency components of the drive signal COM-A that passes through the band pass filter 570, is cut and is fed back to the terminal Ifb.

Here, the drive signal COM-A that is output from the terminal Out is obtained by smoothing the amplified and modulated signal of the connection point (terminal Sw) between the first transistor M1 and the second transistor M2, using a low pass filter that is configured by the inductor L1 and the capacitor C1. The drive signal COM-A is integrated and subtracted via the terminal Vfb, is then positively fed back to the adder 512, and thus, self-excited-oscillation is performed at a frequency that is determined by a delay (sum of a delay caused by smoothing of the inductor L1 and the capacitor C1, and a delay caused by the integral attenuator 516) of feedback and transfer function of feedback.

However, there is a case in which, since a delay amount of a feedback path passing through the terminal Vfb is large, the frequency of the self-excited oscillation cannot be increased only by feedback to the extent that accuracy of the drive signal COM-A can be sufficiently ensured.

Accordingly, in the present embodiment, differently from the path passing through the terminal Vfb, a path through which the high frequency components of the drive signal COM-A are fed back through the terminal Ifb is provided, and thereby delay is reduced from the viewpoint of the entire circuit. For this reason, the frequency of the signal As that is obtained by adding the high frequency components of the drive signal COM-A to the signal Ab is increased to an extent that accuracy of the drive signal COM-A can be sufficiently ensured, compared to a case in which a path passing through the terminal Ifb does not exist.

Figure 11:
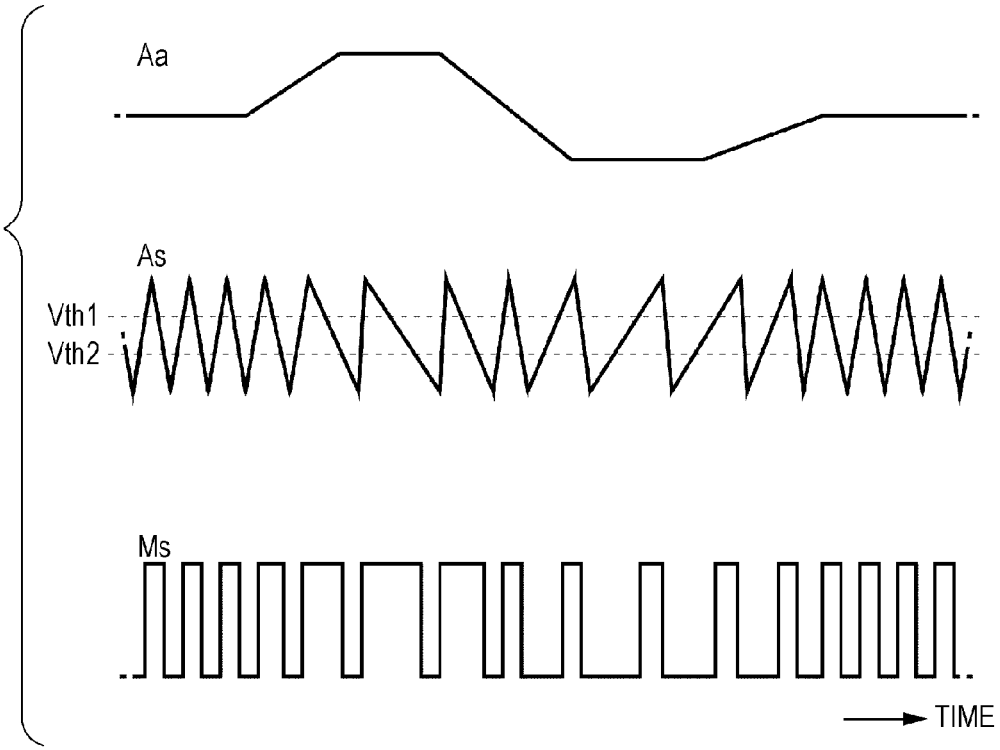
FIG. 11 is a diagram illustrating an operation of the drive circuit.

FIG. 11 is a diagram illustrating the waveforms of the signal As and the modulation signal Ms in association with the waveform of the analog signal Aa.

As illustrated in FIG. 11, the signal As is a triangle wave, an oscillation frequency of the signal varies depending on the voltage (input voltage) of the analog signal Aa. Specifically, in a case in which the input voltage has a medium value, the signal As has the highest value, as the input voltage increases from a medium value to a higher value or decreases, the signal As has a lower value.

In addition, in the signal As, a slope of the triangle wave is substantially equal at the time of rising (rising of a voltage) and falling (falling of a voltage). For this reason, a duty ratio of the modulated signal Ms that is obtained by comparing the signal As with the threshold voltages Vth1 and Vth2 using the comparator 514, becomes approximately 50%. If the input voltage increases from the medium value, a downward slope of the signal As becomes gentle. For this reason, a period in which the modulated signal Ms goes to an H level is relatively elongated, and the duty ratio is increased. Meanwhile, as the input voltage decreases from the medium value, the downward slope of the signal As becomes gentle. For this reason, a period in which the modulated signal Ms goes to an H level is relatively shortened, and the duty ratio is decreased.

For this reason, the modulated signal Ms becomes a pulse density modulation signal as follows. That is, the duty ratio of the modulated signal Ms is approximately 50% at the medium value of the input voltage, as the input voltage increases more than the medium value, the duty ratio is increased, and as the input voltage decreases more than the medium value, the duty ratio is decreased.

The first gate driver 521 turns on or off the first transistor M1 based on the modulated signal Ms. That is, the first gate driver 521 turns on the first transistor M1 if the modulated signal Ms is in an H level, and turns off the first transistor M1 if the modulated signal Ms is in an L level. The second gate driver 522 turns on or off the second transistor M2 based on a logically inverted signal of the modulated signal Ms. That is, the second gate driver 522 turns off the second transistor M2 if the modulated signal Ms is in an H level, and turns on the second transistor M2 if the modulated signal Ms is in an L level.

Thus, a voltage of the drive signal COM-A that is obtained by smoothing the amplified and modulated signal of the connection point between the first transistor M1 and the second transistor M2, using the inductor L1 and the capacitor C1 increases, as the duty ratio of the modulated signal Ms increases, and decreases, as the duty ratio decreases. Thus, as a result, the drive signal COM-A is controlled so as to be a signal that is obtained by expanding the voltage of the analog signal Aa, and is output.

The drive circuit 50 uses a pulse density modulation, and thus there is an advantage that a modulation frequency takes a large variation width of the duty ratio, compared to a fixed pulse width modulation.

That is, a minimum positive pulse width and a minimum negative pulse width which are handled by the entire circuit are constrained by circuit characteristics, and thus, in a pulse width modulation of fixed frequency, only a predetermined range (for example, range from 10% to 90%) can be ensured as a variation width of the duty ratio. In contrast to this, in a pulse density modulation, as the input voltage is separated from a medium value, an oscillation frequency is decreased, and thus at an area in which the input voltage is high, the duty ratio can be increased more. In addition, at an area in which the input voltage is low, the duty ratio can be decreased more. For this reason, in a pulse density modulation of a self-oscillation type, a wider range (for example, range from 5% to 95%) can be ensured as a variation width of the duty ratio.

In addition, the drive circuit 50 performs a self-excited oscillation, and a circuit that generates a carrier wave with a high frequency is not required in the same manner as a separately-excited oscillation. For this reason, there is an advantage that a portion other than a circuit for handling a high voltage, that is, the integrated circuit device 500 is easily integrated.

In addition, the drive circuit 50 includes not only a path passing through the terminal Vfb but also a path on which high frequency components are fed back via the terminal Ifb, as a feedback path of the drive signal COM-A, and thus the delay is decreased from a viewpoint of the entire circuit. For this reason, the frequency of self-excited oscillation becomes high, and thereby the drive circuit 50 can generate the drive signal COM-A with high accuracy.

Returning to FIG. 10, in the example illustrated in FIG. 10, the resistor R1, the resistor R2, the first transistor M1, the second transistor M2, the capacitor C5, a diode D10, and a low pass filter 560 configure an output circuit 550 that generates the amplified and modulated signal based on the modulated signal, generates the drive signal based on the amplified and modulated signal, and outputs the signal to a capacitive load (piezoelectric element 60).

The first power supply unit 530 applies signals to terminals of the piezoelectric elements 60, other than terminals to which the drive signal are applied. The first power supply unit 530 is configured by a constant voltage circuit such as a band gap reference circuit. The first power supply unit 530 outputs the voltage VBS from the terminal VBS. In the example illustrated in FIG. 10, the first power supply unit 530 generates the voltage VBS by using a ground potential of the ground terminal Gnd as a reference.

The voltage boosting circuit 540 supplies the power supply voltage to the gate driver 520. The voltage boosting circuit 540 can be configured by a charge pump circuit, a switching regulator, or the like. In the example illustrated in FIG. 10, the voltage boosting circuit 540 generates a voltage Vm that becomes a power supply voltage on a high potential side of the second gate driver 522. In addition, the voltage boosting circuit 540 generates the voltage Vm by boosting a voltage Vdd based on a ground potential of the ground terminal Gnd.

In the present embodiment, the gate driver 520 and the first power supply unit 530 are connected to the common ground terminal Gnd.

According to the present embodiment, the gate driver 520 and the first power supply unit 530 are connected to the common ground terminal Gnd, and thereby, in a case in which noise is superimposed on a ground potential, noise that is superimposed on signals which are applied to both terminals of the piezoelectric element 60, is cancelled each other out. Therefore, the voltage that is applied to the piezoelectric element 60 can be accurately controlled, and thus it is possible to realize the liquid ejecting apparatus 1, the head unit 20, the integrated circuit device 500 for driving a capacitive load, and the capacitive load driving circuit 50 which can increase ejection accuracy of liquid.

In the present embodiment, the second gate driver 522 and the first power supply unit 530 are connected to the common ground terminal Gnd.

According to the present embodiment, the second gate driver 522 and the first power supply unit 530 are connected to the common ground terminal Gnd, and thus, and thereby, in a case in which noise is superimposed on a ground potential, noise that is superimposed on signals which are applied to both terminals of the piezoelectric element 60, is cancelled each other out. Therefore, the voltage that is applied to the piezoelectric element 60 can be accurately controlled, and thus it is possible to realize the liquid ejecting apparatus 1, the head unit 20, the integrated circuit device 500 for driving a capacitive load, and the capacitive load driving circuit 50 which can increase ejection accuracy of liquid.

In the present embodiment, the gate driver 520, the first power supply unit 530, and the voltage boosting circuit 540 are connected to the common ground terminal Gnd.

According to the present embodiment, noise of the ground potential caused by the voltage boosting circuit 540 can be in the same phase by the first power supply unit 530 and the voltage boosting circuit 540. According to this, noise that is superimposed on signals which are applied to both terminals of the piezoelectric element 60, is cancelled each other out. Therefore, the voltage that is applied to the piezoelectric element 60 can be accurately controlled, and thus it is possible to realize the liquid ejecting apparatus 1, the head unit 20, the integrated circuit device 500 for driving a capacitive load, and the capacitive load driving circuit 50 which can increase ejection accuracy of liquid.

In the present embodiment, the voltage boosting circuit 540 may be a charge pump circuit. According to the present embodiment, occurrence of noise can be suppressed, compared to a case in which a switching regulator circuit is used as the voltage boosting circuit 540. Therefore, the voltage that is applied to the piezoelectric element 60 can be accurately controlled, and thus it is possible to realize the liquid ejecting apparatus 1, the head unit 20, the integrated circuit device 500 for driving a capacitive load, and the capacitive load driving circuit 50 which can increase ejection accuracy of liquid.

In the present embodiment, an oscillation frequency of the modulated signal may be equal to or higher than 1 MHz and equal to or lower than 8 MHz.

In the liquid ejecting apparatus 1 described above, the amplified and modulated signal and thereby the drive signal is generated, the drive signal is applied and thereby the piezoelectric element 60 is displaced, and thus the ink is ejected from the nozzle 651. Here, if a frequency spectrum of the waveform of the drive signal for ejecting, for example, a small dot using the liquid ejecting apparatus 1 is analyzed, it is found that frequency components equal to or higher than 50 kHz are contained. In order to generate a drive signal that contains the frequency components equal to or higher than 50 kHz, it is necessary to set the frequency (frequency of self-excited oscillation) of the drive signal to a frequency equal to or higher than 1 MHz.

If the frequency is lower than 1 MHz, an edge of the waveform of the drive signal to be reproduced becomes dull thereby becoming round. If the waveform of the drive signal becomes dull, the displacement of the piezoelectric element 60 that operates according to a rising edge and a falling edge of the waveform becomes loose, tailing at the time of ejection, or ejection failure occurs, and thereby printing quality is decreased.

Meanwhile, if the frequency of self-excited oscillation is higher than 8 MHz, resolution of the waveform of the drive signal is enhanced. However, as the switching frequency of the transistor is increased, switching loss is increased, and power saving properties having superiority and heat removing properties are impaired, compared to linear amplification of a class AB amplifier or the like.

For this reason, it is preferable that, in the liquid ejecting apparatus 1, the head unit 20, the integrated circuit device 500 for driving a capacitive load, and the capacitive load driving circuit 50 which are described above, the frequency of the modulated signal is equal to or higher than 1 MHz and is equal to or lower than 8 MHz.

3. Layout Configuration of Integrated Circuit Device

Figure 12:
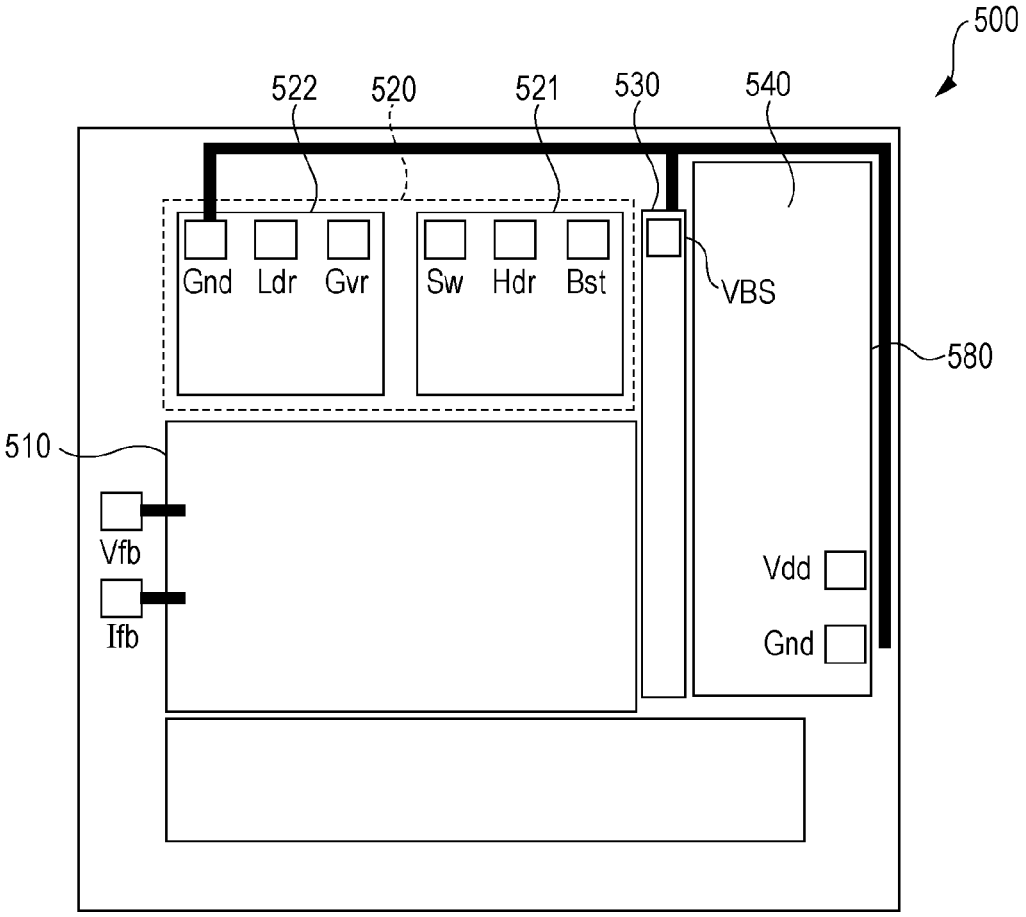
FIG. 12 is a plan view schematically illustrating an example of a layout configuration of an integrated circuit device.

FIG. 12 is a plan view schematically illustrating an example of a layout configuration of the integrated circuit device 500. In FIG. 12, only major terminals among the respective terminals illustrated in FIG. 10 are illustrated. The ground terminal Gnd in the inside of the second gate driver 522, and the ground terminal Gnd in the inside of the voltage boosting circuit 540 are electrically connected to each other by a wire 580. In addition, the wire 580 is also electrically connected to the first power supply unit 530.

In the example illustrated in FIG. 12, the first power supply unit 530 and the voltage boosting circuit 540 are adjacently positioned.

According to the present embodiment, the first power supply unit 530 with a stable potential, and the voltage boosting circuit 540 that is a source of noise are adjacently positioned, and thus it is possible to prevent the noise from transferring to other circuit blocks. Thus, a voltage that is applied to the piezoelectric element 60 can be accurately controlled, and thus, it is possible to realize the liquid ejecting apparatus 1, the head unit 20, the integrated circuit device 500 for driving a capacitive load, and the capacitive load driving circuit 50 which can increase ejection accuracy of liquid.

In addition, in the example illustrated in FIG. 12, the first power supply unit 530 is positioned on the shortest straight line path between the gate driver 520 and the voltage boosting circuit 540. According to this, it is possible to suppress that the noise which is generated by the voltage boosting circuit 540 affects the gate driver 520.

Figure 13:
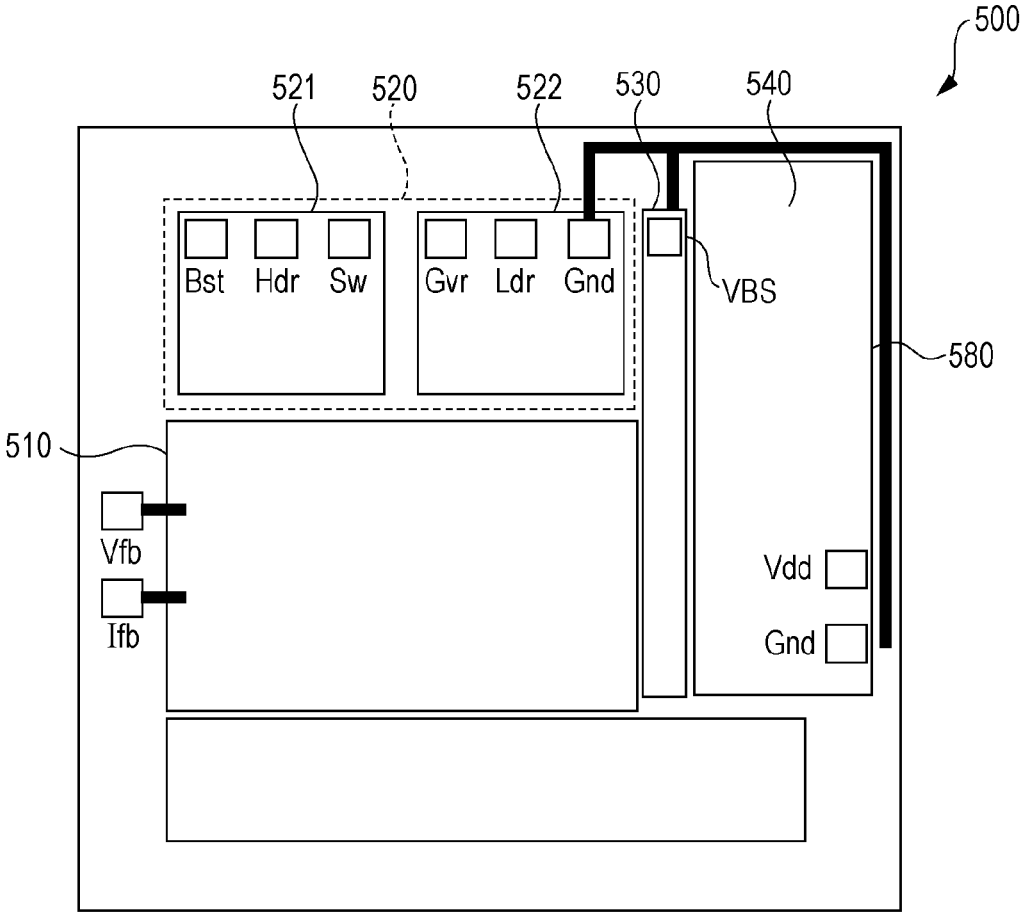
FIG. 13 is a plan view schematically illustrating another example of the layout configuration of the integrated circuit device.

FIG. 13 is a plan view schematically illustrating another example of the layout configuration of the integrated circuit device 500. Detailed description with regard to a configuration that is the same as the configuration illustrated in FIG. 12 will be omitted.

In the example illustrated in FIG. 13, the ground terminal Gnd of the second gate driver 522 is configured by a closest terminal to the first power supply unit 530 among the terminals of the gate driver 520. According to this, a wire impedance from the ground terminals Gnd of the second gate driver 522 to the first power supply unit 530 can be reduced, and thus it is possible to supply an accurate ground potential to the first power supply unit 530. Thus, it is possible to realize the liquid ejecting apparatus 1, the head unit 20, the integrated circuit device 500 for driving a capacitive load, and the capacitive load driving circuit 50 which can increase ejection accuracy of liquid.

In addition, also in the layout configuration illustrated in FIG. 13, the same effect can be obtained by the same reason as the layout configuration illustrated in FIG. 12.

As described above, the present embodiment or the modification example are described, but the invention is not limited to the present embodiment or the modification example, and can be implemented in various forms in a range without departing from the spirit thereof.

The invention includes substantially the same configuration (for example, function, method, and configuration having the same result, or configuration having the same purpose and effect) as the configuration described in the embodiment. In addition, the invention includes a configuration in which a non-essential portion of the configuration described in the embodiment is replaced. In addition, the invention includes a configuration having the same operations and effects as the configuration described in the embodiment, or a configuration by which the same purpose can be achieved. In addition, the invention includes a configuration in which a known technology is added to the configuration described in the embodiment.

What is claimed is:

1. A liquid ejecting apparatus comprising:

a modulator that generates a modulated signal which is obtained by pulse-modulating an original signal;

a gate driver that generates a control signal, based on the modulated signal;

a transistor that generates an amplified and modulated signal obtained by amplifying the modulated signal based on the control signal from the gate driver, wherein the gate driver operates the transistor by way of the control signal to control the transistor in an OFF-state or an ON-state for amplifying the modulated signal;

a low pass filter that generates a drive signal by demodulating the amplified and modulated signal;

a piezoelectric element that is displaced by the drive signal which is applied;

a first power supply that applies a signal to a terminal of the piezoelectric element, other than a terminal to which the drive signal is applied;

a cavity which is filled with a liquid therein, and whose internal volume is changed by displacement of the piezoelectric element; and a nozzle that communicates with the cavity, and ejects the liquid in the cavity as droplets in accordance with change of the internal volume of the cavity, wherein the gate driver and the first power supply are connected to a common ground terminal.

2. The liquid ejecting apparatus according to claim 1, wherein the gate driver includes a first gate driver; and a second gate driver that operates at a potential side lower than that of the first gate driver, and wherein the second gate driver and the first power supply are connected to the common ground terminal.

3. The liquid ejecting apparatus according to claim 1, further comprising:

a voltage boosting circuit that supplies a power supply voltage to the gate driver, wherein the gate driver, the first power supply and the voltage boosting circuit are connected to the common ground terminal.

4. The liquid ejecting apparatus according to claim 3, wherein the first power supply and the voltage boosting circuit are adjacently positioned.

5. The liquid ejecting apparatus according to claim 3, wherein the voltage boosting circuit is a charge pump circuit.

6. The liquid ejecting apparatus according to claim 1, wherein an oscillation frequency of the modulated signal is equal to or higher than 1 MHz and is equal to or lower than 8 MHz.

7. A head unit comprising:

a modulator that generates a modulated signal which is obtained by pulse-modulating an original signal;

a gate driver that generates a control signal, based on the modulated signal;

a transistor that generates an amplified and modulated signal obtained by amplifying the modulated signal based on the control signal from the gate driver, wherein the gate driver operates the transistor by way of the control signal to control the transistor in an OFF-state or an ON-state for amplifying the modulated signal;

a low pass filter that generates a drive signal by demodulating the amplified and modulated signal;

a piezoelectric element that is displaced by the drive signal which is applied;

a first power supply that applies a signal to a terminal of the piezoelectric element, other than a terminal to which the drive signal is applied;

a cavity which is filled with a liquid therein, and whose internal volume is changed by displacement of the piezoelectric element; and a nozzle that communicates with the cavity, and ejects the liquid in the cavity as droplets in accordance with change of the internal volume of the cavity, wherein the gate driver and the first power supply are connected to a common ground terminal.

* * * * *